US007876231B2

(12) United States Patent
Kim et al.

(10) Patent No.: US 7,876,231 B2
(45) Date of Patent: Jan. 25, 2011

(54) INTEGRATED MANAGEMENT SYSTEM FOR MULTI-AIR CONDITIONER AND INTEGRATED MANAGEMENT METHOD THEREOF

(75) Inventors: Jun-Tae Kim, Seoul (KR); Sang-Chul Youn, Seoul (KR); Duck-Gu Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 11/948,545

(22) Filed: Nov. 30, 2007

(65) Prior Publication Data

US 2008/0186160 A1 Aug. 7, 2008

(30) Foreign Application Priority Data

Feb. 6, 2007 (KR) ..... 10-2007-0012338

(51) Int. Cl.
*G08B 21/00* (2006.01)
*G05D 23/00* (2006.01)
*G06F 11/00* (2006.01)

(52) U.S. Cl. ..... 340/679; 340/680; 340/681; 340/682; 340/683; 340/684; 700/275; 700/276; 702/188

(58) Field of Classification Search ..... 340/679–684; 700/275–276; 702/188
See application file for complete search history.

(56) References Cited

U.S. PATENT DOCUMENTS

| | | | | |
|---|---|---|---|---|
| 3,638,191 | A * | 1/1972 | Mann | 340/3.6 |
| 6,297,742 | B1 * | 10/2001 | Canada et al. | 340/635 |
| 6,778,893 | B2 * | 8/2004 | Murakami et al. | 701/50 |
| 7,034,710 | B2 * | 4/2006 | Falada et al. | 340/679 |
| 2002/0095269 | A1 * | 7/2002 | Natalini et al. | 702/188 |
| 2006/0273918 | A1 * | 12/2006 | Ram et al. | 340/679 |

FOREIGN PATENT DOCUMENTS

| | | | |
|---|---|---|---|
| JP | 2003-44968 | A | 2/2003 |
| JP | 2004-214941 | A | 7/2004 |
| KR | 10-2006-0100182 | A | 9/2006 |

* cited by examiner

*Primary Examiner*—Benjamin C Lee
*Assistant Examiner*—Lam P Pham
(74) *Attorney, Agent, or Firm*—Birch, Stewart, Kolasch & Birch, LLP

(57) ABSTRACT

An integrated management system having at least one air conditioner group including a plurality of air conditioners, and a remote integrated management system connected to the at least one air conditioner group and configured to analyze operation state information related to the plurality of air conditioners in the at least one air conditioner group and to generate an alarm signal based on the analyzed operation state information.

9 Claims, 3 Drawing Sheets

INTEGRATED MANAGEMENT SYSTEM FOR MULTI-AIR CONDITIONER AND INTEGRATED MANAGEMENT METHOD THEREOF

This application claims priority to Korean Patent Application No. 10-2007-0012338 filed on Feb. 6, 2007 in Korea, the entire contents of which is hereby incorporated by reference in its entirety.

BACKGROUND OF THE INVENTION

1. Field of the Invention

The present invention relates to an integrated management system for automatically controlling, inspecting and operating multiple air conditioners.

2. Background of the Related Art

Air conditioner systems are now used in most buildings and homes. For example, one type of air conditioner system includes indoor units disposed in each room at a home or each office in a building, and an outdoor unit shared by and connected to the indoor units. Thus, there are multiple air conditioner components included in an air conditioner system. Further, in larger homes and buildings, there are often multiple air conditioner systems provided throughout the homes and buildings.

The multiple air conditioners are controlled so that they maintain rooms at a particular temperature. For example, during the summer months, the multiple air conditioners may be controlled to maintain a room at a temperature of 70 degrees. However, because the air conditioner systems include many components (indoor units, outdoor units, pipes connected the different units, etc.), the multiple air conditioner systems must be maintained and repaired.

Currently, the inspection and repair of components is performed once every year, etc. In many home environments, the air conditioner system may never be inspected, and is only repaired when the home owner discovers the air conditioner system is not working properly. In buildings, the air conditioner system is generally manually inspected by an engineer once a year, for example. Further, when an employee or other personnel in the building notices their respective room is not being maintained within the desired temperature, the person contacts the engineer or manager of the building, who then comes to the respective room to determine why the air conditioner system is not working properly (e.g., the vent is closed, the indoor air conditioner unit is not working properly, etc.). This manual process is time consuming and inefficient.

Further, the maintenance is often manually recorded in a log book or on a computer. This manual maintenance procedure is often time consuming and includes inaccurate data (e.g., the engineer accidentally inputs the wrong date, room number, part number, etc. into the log book).

SUMMARY OF THE INVENTION

Accordingly, one object of the present invention is to address the above-noted and other objects.

Another object of the present invention is to provide a remote integrated management system for automatically collecting and analyzing operation states of multiple air conditioner systems, and automatically sending malfunction information to a service agent when a malfunction occurs in an any of the multiple air conditioners based on the analysis to thereby provide a rapid and automated integrated management method.

Another aspect of the present invention is to provide an integrated online management system for multiple air conditioners that determines dates to inspect or check the multiple air conditioners, and automatically transmits a regular inspection alarm signal to a service agent on or before the determined inspection dates so as to provide an automated method of informing service agents when a particular air conditioner (or air conditioners) is to be inspected.

Still another aspect of the present invention is to provide an integrated online management system for multiple air conditioners that collects and analyzes operation states of the multiple air conditioners, determines malfunction information of the multiple air conditioners based on the collected and analyzed operation states, and automatically sends malfunction information to a service agent according to a priority of the malfunction information via an e-mail, short text message, etc.

To achieve these and other advantages and in accordance with the purpose of the present invention, as embodied and broadly described herein, the present invention provides in one aspect an integrated management system including at least one air conditioner group including a plurality of air conditioners, and a remote integrated management system connected to the at least one air conditioner group and configured to analyze operation state information related to the plurality of air conditioners in the at least one air conditioner group, and to generate an alarm signal based on the analyzed operation state information.

In another aspect, the present invention provides a method of controlling at least one air conditioner group including a plurality of air conditioners. The method includes analyzing operation state information related to the plurality of air conditioners in the at least one air conditioner group, and generating an alarm signal based on the analyzed operation state information.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
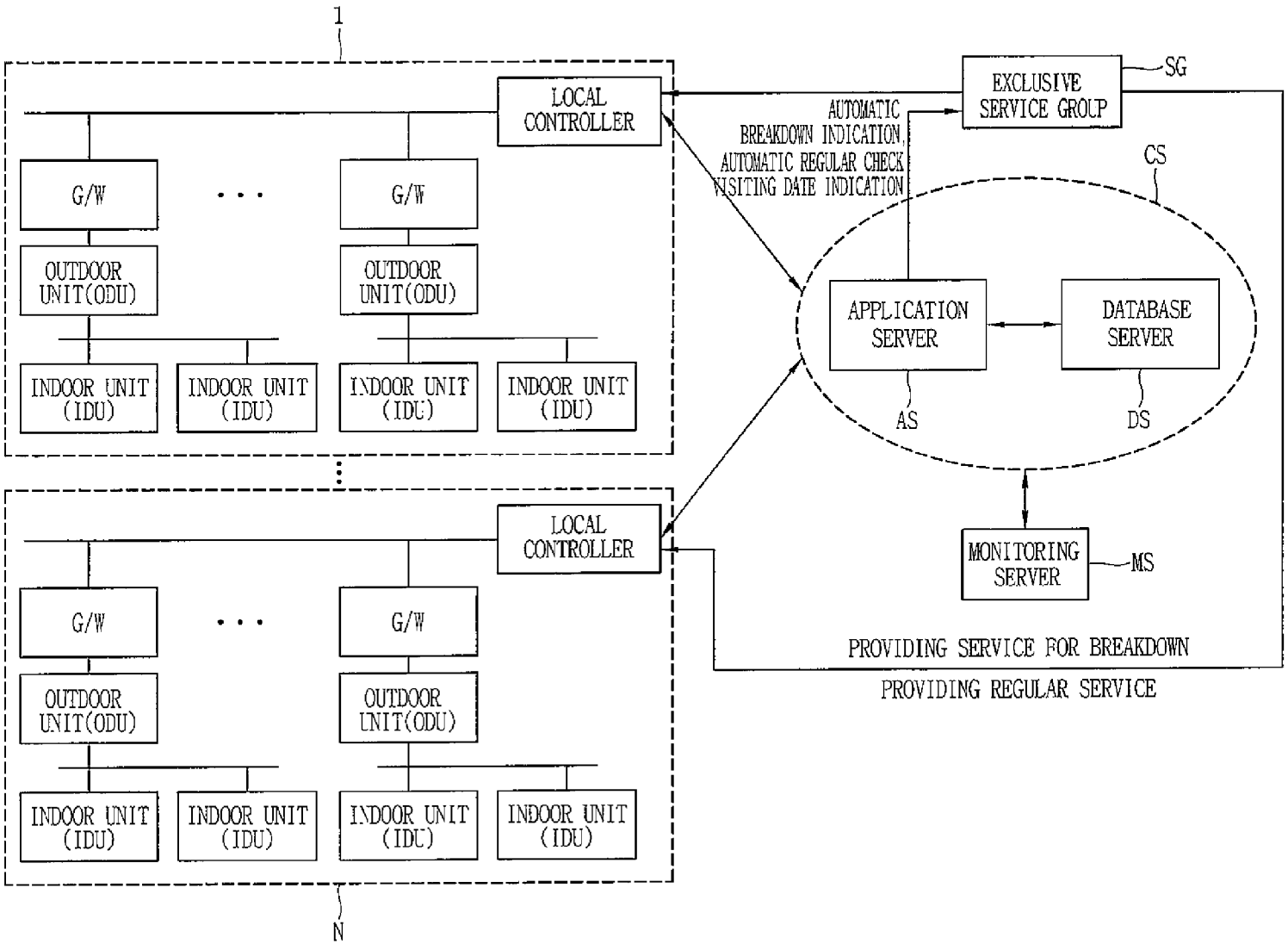
FIG. 1 is a block diagram illustrating an integrated management system for controlling multiple air conditioners according to an embodiment of the present invention.

FIG. 1 is a block diagram illustrating an integrated management system for controlling multiple air conditioners according to an embodiment of the present invention. As shown in FIG. 1, the integrated management system includes a plurality of air conditioner systems 1 to N, a remote integrated management system CS, a monitoring server MS, and an exclusive service group SG.

The air conditioner systems 1 to N include one or more groups of air conditioners, each group having a local controller connected to the multiple air conditioners via a gateway G/W. Further, each local controller in the multiple air conditioner systems 1 to N converts operation state information on the air conditioners included in their respective groups into a remote communication protocol, and transmits the converted data wirelessly or via a cable (wire).

In addition, the operation state information includes breakdown or malfunction information, error occurrence information, information related to a visiting time indicating when the air conditioner or air conditioners are to be inspected, etc. Also, the air conditioner group denotes an air conditioning installation including a plurality of multiple air conditioners capable of satisfying cooling capacities of a corresponding building by connecting at least one indoor unit to one outdoor unit. Further, the local controller collects the operation state information related to the multiple air conditioners/components/indoor and outdoor units, etc. in each corresponding group.

The remote integrated management system CS then receives and analyzes the operation state information from the one or more air conditioner systems 1 to N, generates a malfunction alarm signal based upon the analysis and sends the generated alarm signal to the exclusive service group SG. The malfunction alarm signal indicates there is a problem with a particular air conditioner or air conditioners included in a corresponding group. The alarm signal may also notify a service person or other personnel that the air conditioner or air conditioners in a group are to be inspected at a particular date and time.

In addition, as shown in FIG. 1, the remote integrated management system CS includes an application server AS, a database server DS and a monitoring server MS. The monitoring server MS is illustrated as being connected to the management system CS, but is considered as part of the management system CS in this embodiment. Further, the application server AS analyzes the operation state information, checks the malfunction information based upon the analyzed result, and generates a malfunction alarm signal for indicating a malfunction according to a remote communication protocol.

In addition, the database server DS stores a service record or history corresponding to the determined malfunctions, the service that has been performed, and other data corresponding to the method of controlling the multiple air conditioners. Further, the monitoring server MS displays malfunction information related to a particular air conditioner group or air conditioners included in a group, and priority information about the priority of collected and analyzed malfunction and other operational state information to a user or service personnel. In more detail, the application server AS can include a storage unit for storing previously determined priorities according to an importance of a particular malfunction.

Further, as discussed above, the malfunction information includes, for example, information about a broken component, information related to a broken product, information about different types of errors, information related to an importance of an error, etc. Therefore, the application server AS can analyze the malfunction information, determine whether the malfunction should be rapidly repaired or processed according to the analyzed result, and send a breakdown alarm signal via e-mail or other type of short message to a service personnel.

For example, the application server AS may send a short message (voice or text message) to a service agency or a service engineer when a malfunction is determined to have a high priority, or send a report concerning the malfunction via an e-mail when the malfunction is determined to have a low priority.

The remote integrated management system CS also generates an inspection alarm signal for indicating a group of air conditioners (or a particular air conditioner) needs to be inspected at a particular date and time. In addition, the exclusive service group SG receives the malfunction and inspection alarm signal from the remote integrated management system CS and uses the alarm signal to service the malfunction or to inspect the air conditioner(s).

Further, the application server AS may also determine or calculate an appropriate visiting time (date) for the regular inspection service for groups of air conditioners (or for a single air conditioner), and generate a regular inspection alarm signal at the determined visiting date. The alarm signal is then used by a service personnel to inspect or check the indicated air conditioners. The database server DS then stores a service record/history indicating that the air conditioners have been inspected after completing the service.

The monitoring server MS may also display the inspection time of a desired conditioner system, the regular service history and other information to a user or service personnel such that the user or service personnel can monitor and manage the multiple air conditioning systems in an effective manner.

Thus, as discussed above, the remote integrated management system CS receives and analyzes operation state information from at least one conditioner system, generates a visiting date alarm signal indicating the corresponding air conditioner system needs to be inspected at a particular date and time based on the analyzed result and sends the generated alarm signal to the exclusive service group SG. Malfunction information is determined and handled in a similar manner.

Further, the application server AS includes an appropriate communication unit (not shown) for collecting or sending the operation state information (i.e., malfunction information, error occurrence information, information about a visiting date for a regular checkup, etc.). The communication unit uses an Internet communication, a wireless communication and/or a wired communication method.

Figure 2:
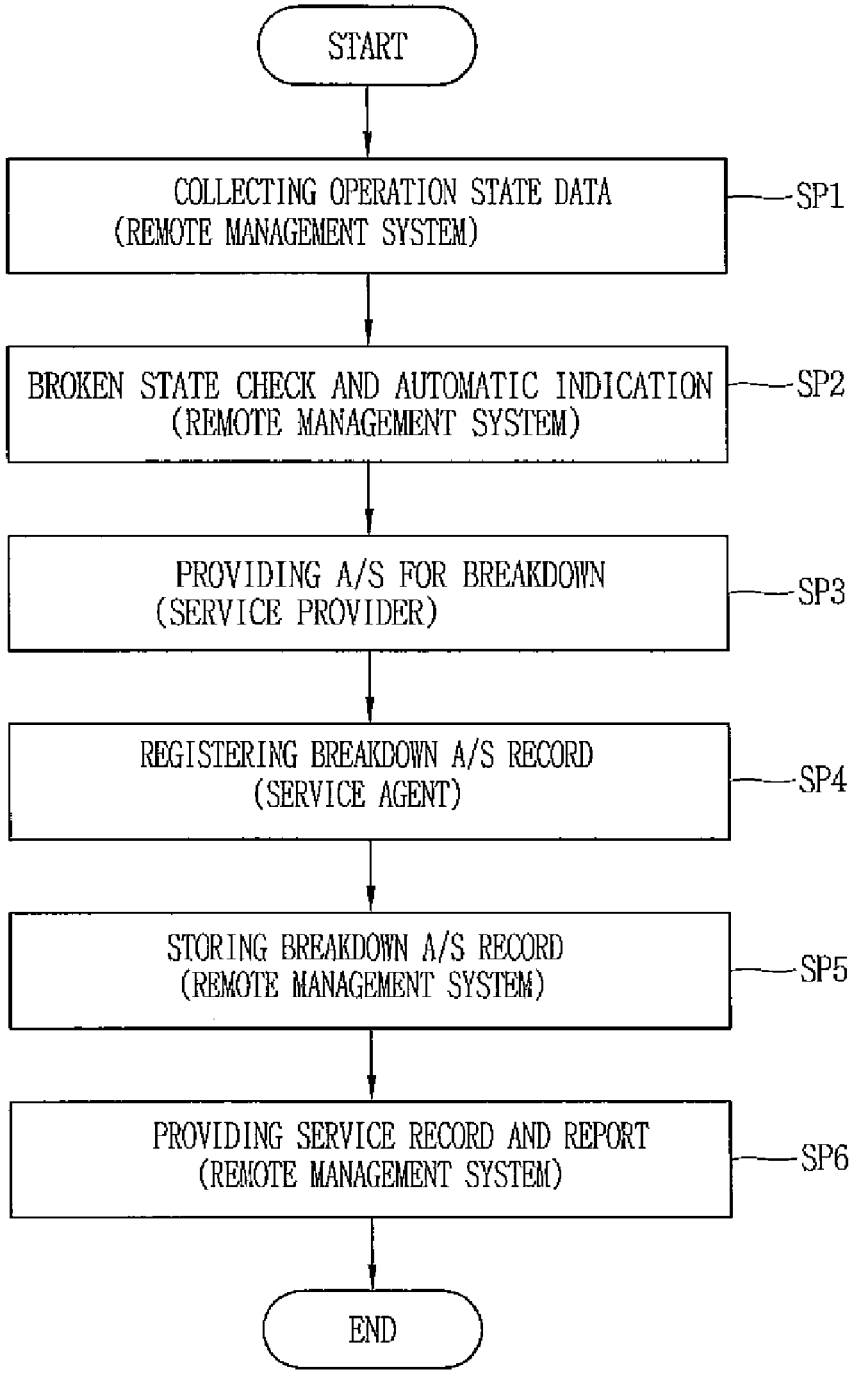
FIG. 2 is a flowchart illustrating an integrated management method for controlling multiple air conditioners according to an embodiment of the present invention.

An operation of the integrated management system will now be described with respect to the flowchart shown in FIG. 2. FIG. 1 will also be referred to in this description. As shown in FIG. 2, each corresponding local controller of the air conditioner systems 1 to N collects operation state information related to air conditioners included in the corresponding group, and periodically sends the collected operation state information to the remote integrated management system CS (step SP1).

Thus, in step SP1, when an air conditioner system includes a component that has malfunctioned, the local controller of the corresponding air conditioner system 1 to N sends the malfunction related information as the operation state information to the remote integrated management system CS.

Accordingly, after a sufficient amount of operation state information is collected, the remote integrated management system CS analyzes the collected operation state information to determine what procedure, if any, is needed to address the information provided in the operation state information (step SP2). For example, if the operation state information indicates one or more of the air conditioners has malfunctioned, the remote integrated management system CS sends an automatic breakdown alarm signal to the exclusive service group SG. If the operation state information indicates one or more air conditioners needs a regular checkup, the management system CS sends a regular checkup or inspection signal to the service group SG such that a service personnel is notified that the one or more air conditioners needs a regular checkup.

That is, the application server AS analyzes the operation state information received from each of the air conditioner systems 1 to N, and determines what procedures need to be performed. When a regular inspection is detected, the application server AS converts the appropriate alarm signal according to a remote communication protocol, and sends the converted data to the exclusive service group SG. If a malfunction occurs in one of the air conditioning systems, the operation state information includes malfunction information.

In addition, if the application server AS determines the malfunctioning air conditioner needs to be immediately repaired based on the analysis of the malfunction information, the application server AS sends the malfunction alarm signal directly to the service agent (service engineer) via a short message. That is, when a malfunction has a high priority, the application server AS sends a short message to a service agency or a service engineer. When the malfunction has a low priority, the application server AS sends a report including the malfunction information to the service agency or the service engineer via an e-mail. The priority values for the different types of malfunctions may be previously stored in the database DS.

Then, as shown in FIG. 2, the exclusive service group SG checks the malfunction information received from the remote integrated management system CS and an appropriate service personnel services the breakdown (step SP3). A service agent of the exclusive service group SG then stores the service record of the corresponding multi-air conditioner system 1 to N in the database server DS (step SP4 and SP5). That is, when the service agent accesses the remote integrated management system CS, the remote integrated management system CS provides a malfunction information list to the service agent. Accordingly, the service agent can select an item from the list. The service agent then selects the service record for the item, services the malfunctioning item, and stores a record of the service and other related information in the database server DS.

Further, remote integrated management system CS manages the service record stored in the database server DS and sends the service record to the exclusive service group SG (SP6). That is, the monitoring server MS of the remote integrated management system CS displays the malfunction information related to the air conditioner systems 1 to N desired by the manager, the priority of malfunction processing, and the service record.

Figure 3:
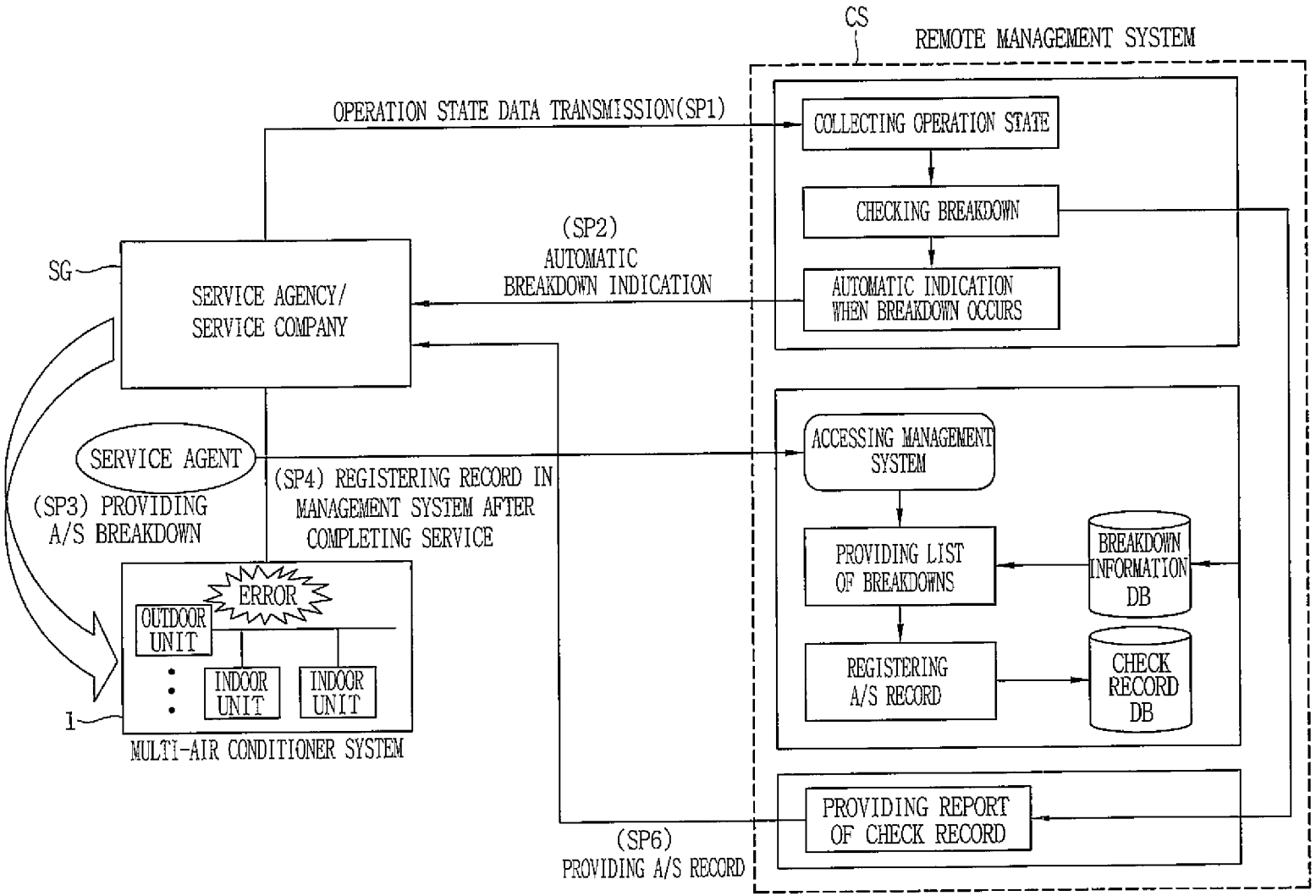
FIG. 3 is a schematic view illustrating operations in an integrated management method for controlling multiple air conditioners according to an embodiment of the present invention.

Next, FIG. 3 is a schematic view illustrating an integrated management method for controlling multiple air conditioners according to an embodiment of the present invention. In this description, the remote integrated management system CS checks (or calculates) a date for a regular checkup for at least one of the air conditioner systems 1 to N, and automatically sends a message indicating the regular checkup date to the exclusive service group SG.

In more detail, the remote integrated management system CS checks or calculates a visiting date and time that the service personnel should perform a regular inspection or checkup service with respect to the at least one of the air conditioner systems 1 to N, generates a regular inspection alarm signal on or before the visiting date, and sends the alarm signal to the exclusive service group SG.

Further, the regular inspection alarm signal may be generated and sent before the visiting date to the exclusive service group SG so the service personnel has a warning about the upcoming regular inspection date. Thus, the application server AS checks the visiting dates for the regular inspection service with respect to the air conditioner systems 1 to N, generates the regular inspection alarm signal on or before the checked visiting dates, and sends the alarm signal to the exclusive service group SG.

Accordingly, the exclusive service group SG evaluates the regular inspection alarm signal received from the remote integrated management system CS, and then provides the regular inspection service for the targeted multi-air conditioner system 1 to N. In addition, the service agent of the exclusive service group SG registers the regular inspection service record of the corresponding air conditioner system 1 to N in the database server DS.

Thus, the remote integrated management system CS manages the regular inspection service record stored in the database server DS and also sends the regular inspection service record to the exclusive service group SG. The monitoring server MS of the remote integrated management system CS also displays a regular inspection service record of the air conditioner systems 1 to N that is desired by a manager, for example.

That is, in the present invention, the remote integrated management system CS collects and analyzes the operation states of a plurality of air conditioner systems, and automatically sends malfunction information to the service agent when a malfunction occurs in an air conditioner. The management system also monitors when a particular regular inspection service is needed for each air conditioner system (e.g., once a year, twice a year, during a change of seasons, etc.), and notifies a service personnel that a particular service is needed on a particular date. Also, the corresponding malfunction information can be sent via an e-mail or a short message according to the priority of the malfunction.

For example, if an air conditioner system included in a computer room malfunctions, a high priority would be assigned to this event such that the air conditioner system is immediately serviced. A service manager may previously set priority levels for each particular air conditioner system and store the priority levels in a database. The priority levels are then used together with the malfunction alarm signal such that a service personnel can immediately determine whether the air conditioner system needs to be immediately serviced. The different types of malfunctions may also be assigned priority levels.

Also, as discussed above, the remote integrated management system CS determines or checks the regular service inspection date for at least one of the air conditioner systems, and automatically sends a corresponding regular inspection alarm signal on or before the checkup date such that a service personnel can determine what air conditioners need to be serviced or inspected (e.g., once a year, etc). For example, the manufacturer of the air conditioners generally includes information on how often an air conditioner system needs to be serviced (a regular inspection date such as once a year, twice a year, every change of season, etc.).

A manager or other service personnel can then use this information to create a database of inspection dates for their particular air conditioner systems and the environment the air conditioners are operating in. For example, an air conditioner system that operates in a harsh environment (such as air conditioner system operating in a chemical processing plant, an environment that includes a lot of dust particles, etc.) may need to be serviced more often than the manufacturer's recommendation. Thus, the manager or service personnel may decide these types of air conditioner systems need to be checked every other month. The manager or service personnel may then store this information in a database, and the stored information is read by the remote management system once a day, for example, to determine what air conditioners are scheduled for their regular service. The service personnel may also assign priority levels to the different types of malfunctions.

Thus, in accordance with embodiments of the present invention, the air conditioner systems are monitored in a real time fashion. That is, the present invention provides an online intelligent automated system for controlling multiple air conditioners. Further, the integrated management system of the present invention can be applied to a system having multiple air conditioners, a single air conditioner, and components included in each air conditioner.

As described above, the integrated management system for multiple air conditioners collects and analyzes operation states of a plurality of air conditioner systems, and automatically sends malfunction or service information to the service agent when the malfunction occurs in an air conditioner, so as to enable a service personnel to quickly address the particular malfunction.

Also, the remote integrated management system determines or checks regular inspection or service dates for the multiple air conditioners and automatically sends the regular check alarm signal on or before the inspection dates, so as to enable the service personnel to address the regular service needs of the air conditioners in an online manner.

In addition, the alarm signal may be sent to a service personnel via a short message (SMS) for a high priority malfunction or via e-mail for a lower priority malfunction. The different alarm signals including malfunction or service information are sent to the remote management system automatically and without user intervention.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An integrated management system, comprising:

a plurality of air conditioner systems comprising at least one air conditioner group including a plurality of air conditioners, and a local controller connected to the at least one air conditioner group via a gateway and configured to convert operation state information comprising malfunction information, priority information indicating priority levels of the malfunction information and regular inspection service information indicating that at least one air conditioner needs a regular inspection service, related to the plurality of air conditioners according to a remote communication protocol; and a remote integrated management system connected to the plurality of air conditioner systems and configured to receive the converted operation state information from the local controller, to analyze the operation state information related to the plurality of air conditioners in the plurality of air conditioner systems, and to generate an alarm signal based on the analyzed operation state information, wherein the remote integrated management system comprises:

an application server configured to analyze the malfunction information indicating that at least one air conditioner in the at least one air conditioner group has malfunctioned and the priority information indicating priority levels of the malfunction information, and the regular inspection service information indicating that at least one air conditioner needs a regular inspection service, and to transmit an alarm signal to a service personnel based on the analyzed malfunction information and priority information, or the regular inspection service information; and a database server configured to store service records or history corresponding to determined malfunctions, the service that has been performed and other data corresponding to controlling the plurality of air conditioner systems, systems; and a monitoring server configured to display the malfunction information, the regular inspection service information and the priority information for the plurality of air conditioners, wherein the application server is further configured to transmit the alarm signal to the service personnel via a short message when the priority information indicates the priority level of the malfunction is high, and transmit the alarm signal to the service personnel via an email message when the priority information indicates the priority level of the malfunction is low.

2. The system of claim 1, wherein the application server further includes a storage unit configured to store the priority levels of the malfunction information and the service records for the plurality of air conditioners.

3. The system of claim 1, further comprising:

an exclusive service group connected to the local controller and the remote integrated management system and configured to receive the alarm signal from the remote integrated management system and provide service for a corresponding air conditioner based on the alarm signal.

4. The system of claim 1, wherein the malfunction information and the regular inspection service information are transmitted from the at least one air conditioner to the remote management system automatically and without user intervention.

5. The system of claim 1, wherein the malfunction information and the regular inspection service information are transmitted directly to the service personnel.

6. An integrated management method for controlling a plurality of air conditioner systems having at least one air conditioner group including a plurality of air conditioners, a local controller connected to the at least one air conditioner group via a gateway, and a remote integrated management system connected to the at least one air conditioner group, the method comprising:

converting, via the local controller, operation state information comprising malfunction information, priority information indicating priority levels of the malfunction information and regular inspection service information indicating that at least one air conditioner needs a regular inspection service, related to the plurality of air conditioners according to a remote communication protocol;

receiving, via the remote integrated management system, the converted operation state information from the local controller, analyzing the operation state information related to the plurality of air conditioners in the plurality of air conditioner systems, and generating an alarm signal based on the analyzed operation state information;

analyzing, via an application server included in the remote integrated management system, the malfunction information indicating that at least one air conditioner in the at least one air conditioner group has malfunctioned and the priority information indicating priority levels of the malfunction information, and the regular inspection service information indicating that the at least one air conditioner needs a regular inspection service;

transmitting, via the application server, an alarm signal to a service personnel based on the analyzed malfunction information and priority information, or the regular inspection service information; and storing, via a database server included in the remote integrated management system, service records or history corresponding to determined malfunctions, the service that has been performed and other data corresponding to controlling the plurality of air conditioner systems; and displaying the malfunction information, the regular inspection service information and the priority information for the plurality of air conditioners, wherein the generating step transmits the alarm signal to the service personnel via a short message when the priority information indicates the priority level of the malfunction is high, and transmits the alarm signal to the service personnel via an email message when the priority information indicates the priority level of the malfunction is low.

7. The method of claim 6, further comprising:

storing the priority levels of the malfunction information and the service records for the plurality of air conditioners.

8. The method of claim 6, further comprising:

providing service for a corresponding air conditioner based on the alarm signal.

9. The method of claim 6, wherein the malfunction information and the regular inspection service information are transmitted from the at least one air conditioner to the service personnel automatically and without user intervention.

* * * * *